US011258202B2

(12) United States Patent
Weeks

(10) Patent No.: US 11,258,202 B2
(45) Date of Patent: Feb. 22, 2022

(54) SECURE OUTLET DEVICE AND METHOD

(71) Applicant: Jonathon R. Weeks, Denver, CO (US)

(72) Inventor: Jonathon R. Weeks, Denver, CO (US)

( * ) Notice: Subject to any disclaimer, the term of this patent is extended or adjusted under 35 U.S.C. 154(b) by 0 days.

(21) Appl. No.: 16/663,171

(22) Filed: Oct. 24, 2019

(65) Prior Publication Data

US 2021/0126399 A1 Apr. 29, 2021

(51) Int. Cl.

| | |
|---|---|
| ***H01R 13/639*** | (2006.01) |
| ***H01R 24/76*** | (2011.01) |
| ***H01R 25/00*** | (2006.01) |
| ***H01R 31/06*** | (2006.01) |
| *H01R 103/00* | (2006.01) |

(52) U.S. Cl.

CPC ..... *H01R 13/6395* (2013.01); *H01R 24/76* (2013.01); *H01R 25/006* (2013.01); *H01R 31/065* (2013.01); *H01R 2103/00* (2013.01)

(58) Field of Classification Search

CPC .. H01R 13/6395; H01R 24/76; H01R 25/006; H01R 31/065; H01R 2103/00; H01R 13/6271

USPC ..... 439/373, 134, 652, 299, 350, 353, 351

See application file for complete search history.

(56) References Cited

U.S. PATENT DOCUMENTS 2,895,119 A * 7/1959 Montgomery, Jr. ..... H01R 13/6275 439/354
4,449,776 A * 5/1984 Carmo ..... H01R 13/6271 439/350
5,378,163 A * 1/1995 Gladura ..... H01R 13/60 439/134
5,486,117 A * 1/1996 Chang ..... H01R 13/6275 439/353
5,795,176 A * 8/1998 Blaetz ..... H01R 13/5205 439/275
5,934,919 A * 8/1999 Cross ..... H01R 13/6395 439/136
6,146,180 A * 11/2000 Betker ..... H01R 13/6273 439/350
6,146,210 A * 11/2000 Cha ..... H01R 13/2421 439/680
6,767,237 B1 * 7/2004 Shih ..... H01R 13/6392 439/371
6,896,536 B1 * 5/2005 Nguyen ..... H01R 13/6272 439/299
7,014,493 B1 * 3/2006 Battard ..... H01R 13/6395 439/371

(Continued)

OTHER PUBLICATIONS http://www.lockinplug.com/, Lock in Plug, Oct. 24, 2019, 3 pages.

(Continued)

*Primary Examiner* — Marcus E Harcum

(74) *Attorney, Agent, or Firm* — Faegre Drinker Biddle & Reath LLP

(57) ABSTRACT

An article and method for securing electric and data connection plugs to an outlet are disclosed. The article includes an outlet cover with anchoring points and an encasing hood containing a plug with engagement mechanisms to engage with the anchoring points. In an alternate embodiment the article includes a flexible elastomeric device with open portions to secure a plug and cord and cross portions to secure to anchoring points on the outlet cover. The methods include releasably securing the articles to the outlet cover.

15 Claims, 12 Drawing Sheets

(56) References Cited

U.S. PATENT DOCUMENTS 7,410,377 B2 * 8/2008 Wharton ..... H01R 13/633 439/172
7,410,379 B1 * 8/2008 Byrne ..... H01R 13/652 439/215
7,484,988 B2 * 2/2009 Ma ..... H01R 13/502 439/350
7,722,380 B1 * 5/2010 West ..... H01R 13/6395 439/373
7,811,117 B2 * 10/2010 Andrade ..... H01R 13/6392 439/373
8,556,647 B2 * 10/2013 Carmitchel ..... H01R 13/6395 439/354
9,960,556 B1 * 5/2018 Jansma ..... H01R 13/6395
10,374,361 B1 * 8/2019 Lien ..... H01R 24/68
2005/0202709 A1 * 9/2005 Campbell, III .... H01R 13/6395 439/373
2006/0148300 A1 * 7/2006 Huang ..... H01R 13/6275 439/353
2006/0252307 A1 * 11/2006 Koenig ..... H01R 13/6271 439/557
2010/0120276 A1 * 5/2010 White ..... H02G 3/14 439/148
2012/0171883 A1 * 7/2012 Shu ..... H01R 13/6395 439/299
2012/0238121 A1 * 9/2012 Kurumizawa ..... B60L 50/16 439/299
2013/0040486 A1 * 2/2013 Kurumizawa ..... B60L 53/16 439/350
2013/0072046 A1 * 3/2013 Bazayev ..... H01R 13/6273 439/357
2013/0183846 A1 * 7/2013 Kappla ..... G02B 6/4261 439/350
2013/0183855 A1 * 7/2013 Warner ..... H01R 13/6395 439/536
2013/0303014 A1 * 11/2013 Takagi ..... B60L 53/16 439/350
2013/0337669 A1 * 12/2013 Najera ..... B60L 53/16 439/133
2014/0162480 A1 * 6/2014 Schutte ..... H01R 13/447 439/142
2014/0242830 A1 * 8/2014 Garofalo ..... H01R 13/6395 439/373
2014/0322959 A1 * 10/2014 Garofalo ..... H01R 13/6395 439/373
2016/0064850 A1 * 3/2016 Draper, Jr. ..... H01R 13/516 439/137
2018/0342836 A1 * 11/2018 Mancil ..... H01R 13/6395
2019/0148885 A1 * 5/2019 Cyzen ..... H01R 25/003 439/373

OTHER PUBLICATIONS http://www.safety1st.com/, Outlet Cover with Cord Shortener, Aug. 13, 2019, 2 pages.

* cited by examiner

SECURE OUTLET DEVICE AND METHOD

FIELD

The described embodiments relate generally to safety devices and methods. More particularly, the present embodiments relate to securing electronic outlets. In still greater particularity, these embodiments relate to devices and methods for releasably securing electronic plugs to an outlet.

BACKGROUND

Electric appliances are ubiquitous and essential to modern living. Vacuum cleaners, alarm clocks, lights and the like are important parts of our everyday life. As more individuals use portable electronic devices, the cords to power them and the cords to recharge cordless devices become increasingly important. Both from a safety and reliability standpoint it is important that securing the electric connection to an outlet is maintained. This is true not only of electrically powered devices but also of other modular connectors. For example, cords and cables of electronic devices and appliances, such as those used in computer networking, telecommunication equipment, and audio headsets may be in need of securement to an outlet. An RJ 11 or similar type connector may be used to connect telephone lines and similar type connectors may be used to connect other data lines. It is important to maintain the integrity of these connections as well as electrical outlet connections. One problem associated with maintaining connections for such devices is that, accidently or purposely, young children may unplug the electrical cords powering them which raise safety and convenience concerns. In other situations, for example as is common when using a vacuum cleaner, accidental pulling of the cord may result in unwanted disconnection of the vacuum cleaner.

Electrical connections to medical devices such as home CPAP machines and medical equipment in hospitals, computers, power cords for home workshops and construction sites, and office equipment are some other important applications where an interruption in power may cause serious harm and or inconvenience. Inadvertent disconnection of these power cords or their intentional disconnection by a child could result in harm to the child or other individual and possible equipment damage, alarm failure or damage to the surrounding premises such as fire, water damage etc.

Some devices have previously been used to secure these electrical cords to the outlets. For example, one device places a cover over the entire electrical plate and connected plugs. That is, for example, both electrical plugs on a wall outlet are concealed with a secure cover such that plugs inserted into either or both outlets are covered to prevent access without removing the cover. A small opening is provided for cords extending from the plugs to exit the cover. In this manner, disconnection of the plugs from sockets may be prevented by the children pulling out plug. In this device an outer frame is attached to or over the outlet and cover snaps or otherwise attaches to the frame thereby encasing the outlets and plugs. While this provides some protection, it may not be aesthetically pleasing and requires removal of the cover to disconnect one or both plugs. If it is desired to temporarily plug in a phone charger or other device for short term use where only one outlet is otherwise in use, the cover must be opened to access the one open outlet. One example of such device may be seen at www.safety1st.com.

Another previously used device includes a "Lock in Plug" such as may be seen at www.lockinplug.com. This device permanently attaches to an electric plug and then allows the device and attached plug to be removably secured into the outlet. While suited for its intended purpose, because the device is permanently attached to the plug, such devices are for one-device use only. If the electronic device or cord is replaced a new lock in plug device must be obtained to attach to the new plug.

SUMMARY

Described embodiments include a series of receptacle covers and individual encasing hoods that work in conjunction with outlets to prevent the unintended or inappropriate unplugging of plugs from the outlets. These receptacle/outlet covers may replace existing outlet covers of all styles by duplicating their mounting points on the receptacle for ease of installation. The covers may also fit over existing outlet covers. The outlet covers also include anchoring points for the various encasing hoods. The encasing hoods may be attached and detached from the receptacle cover and may be removed from around the individual plugs so to be reusable. The encasing hoods will removably attach to the receptacle covers and may be removed by an adult or person who is capable of understanding the removal protocol and making it more difficult for many young children to do so.

The encasing hoods may be removably attached to the outlet cover for ease of use or may utilize more secure attachment with the use of a key pin so as to make it more difficult to unlock and thus unplug the cord from the outlet. In some embodiments, an electronic release may be utilized, with or without a cell phone app, to disengage one or more of the encasing hoods from the outlet covers.

In another embodiment, an elastic device may be used as the locking mechanism to secure the plug to the outlet cover. The elastic device attaches onto one side of the outlet cover, allowing the plug to go through a center opening in the elastic device. The elastic device is then twisted to secure the plug into the band and the opposite end of the elastic device is attached on the other side of the outlet cover to secure the plug in the receptacle.

Some advantages to the disclosed embodiments include: 1. They are more aesthetically pleasing than a cover over both outlets due to the locking component remaining with the cord rather than on the wall. This eliminates the outlets being inaccessible with large boxes mounted to them; 2. The outlets can be used as any other ordinary outlet when need be, rather than always having to open and navigate a box when it is desirable to plug in a phone or other device momentarily; 3. The encasing hoods may be separated from the plug as desired, whereas other devices are permanently attached to the plug; 4. Disclosed embodiments replace a large complex box in prior devices with an outlet cover including small cavities or protrusions and a minimal locking encapsulating hood or elastic band. The encapsulating hoods are reusable so it may require less locking encapsulating hoods to secure an entire home as needed rather than requiring a new lock in plug for each and every plug. For example, with a permanently locking cover, if a fan in the child's room needs to be replaced, prior art devices that use locking covers permanently attached to the plug must be disposed of with the fan and a new locking cover would need to be purchased for the replacement fan plug.

The device and method may have applications in child safety, general home, workshop, office, medical, day care centers, offices, garages, hospitals, preschools, and construction applications. For example, the devices may be employed to secure electrical plugs for vacuum cleaners, lamps, holiday lights, extension cords, hand tools, CPAP machines, and life support equipment. For computers and other equipment that employ RJ 11 or other data connections, the device and methods may also be used to secure the data connection plug to the receptacle. Other applications and devices not specifically described herein may also advantageously employ embodiments described and claimed herein.

BRIEF DESCRIPTION OF THE DRAWINGS

The disclosure will be readily understood by the following detailed description in conjunction with the accompanying drawings, wherein like reference numerals designate like structural elements, and in which.

DETAILED DESCRIPTION

Figure 1A:
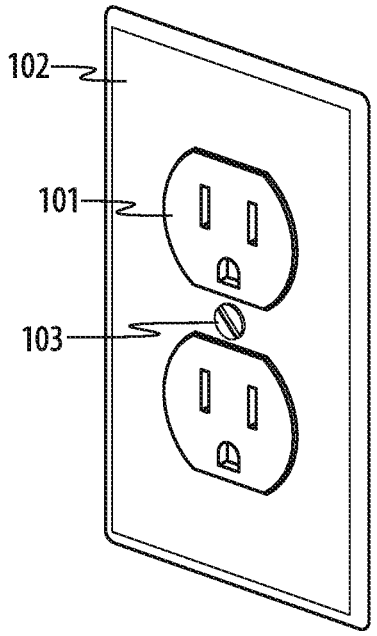
FIG. 1A PRIOR ART
FIGS. 1A and B show front views of conventional electrical outlet covers.

The following disclosure describes in detail representative embodiments with reference to the accompanying drawings (FIGS. 1-12). It should be understood that the following descriptions are not intended to limit the embodiments to one preferred embodiment. To the contrary, it is intended to cover alternatives, modifications, and equivalents as can be included within the spirit and scope of the described embodiments as defined by the appended claims. Like reference numerals denote like structure throughout the description of the various figures.

Figure 1B:
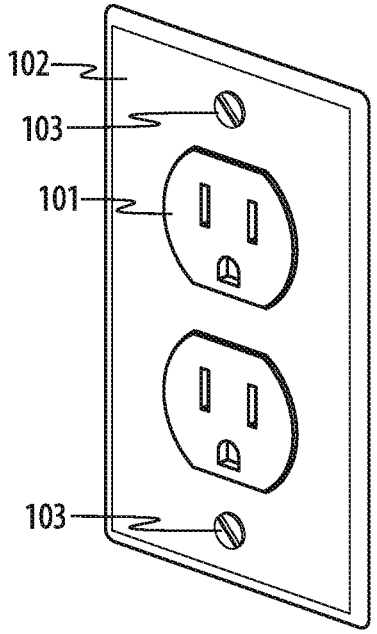
FIG. 1B PRIOR ART

FIGS. 1A and 1B illustrate a conventional electrical outlet 101 and a cover plate 102. In FIG. 1A cover plate 102 is secured to electrical outlet 101 by a screw 103 in the approximate center. In FIG. 1B cover plate is secured to electrical outlet 101 by screws 103 on the ends of cover plate 102. The cover plates disclosed herein may be advantageously utilized with either the center or end attachment of the cover plate to the outlet.

Figure 2:
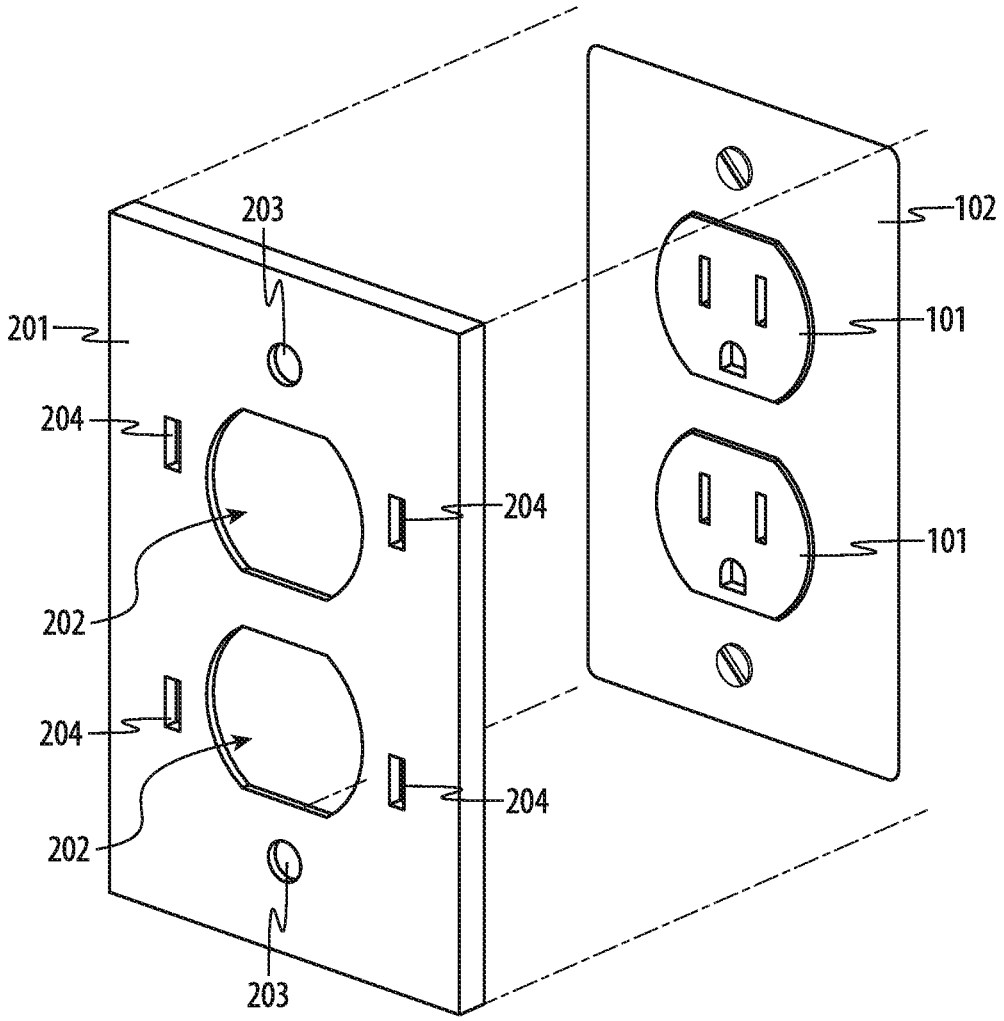
FIG. 2 shows a perspective view of one embodiment of an outlet cover.

FIG. 2 illustrates one embodiment of a cover plate 201 which includes openings 202 to allow access to electrical outlets 101. Cover plate 201 may be attached to the outlet over existing cover 102 or as a replacement therefor at the ends 203 as shown in FIG. 1B above. It should be expressly understood that center attachment 103 as shown in FIG. 1A may also be utilized without departing from the scope of the disclosed embodiments.

Cover plate 201 includes one or more anchoring points which may include recessed portions 204 into which an engagement mechanism (not shown) may be inserted. As will be discussed below, the interaction of the engagement mechanism and the recessed portions 204 may be utilized to secure one or more encasing hoods containing electric plugs into the electrical outlet.

Figure 3:
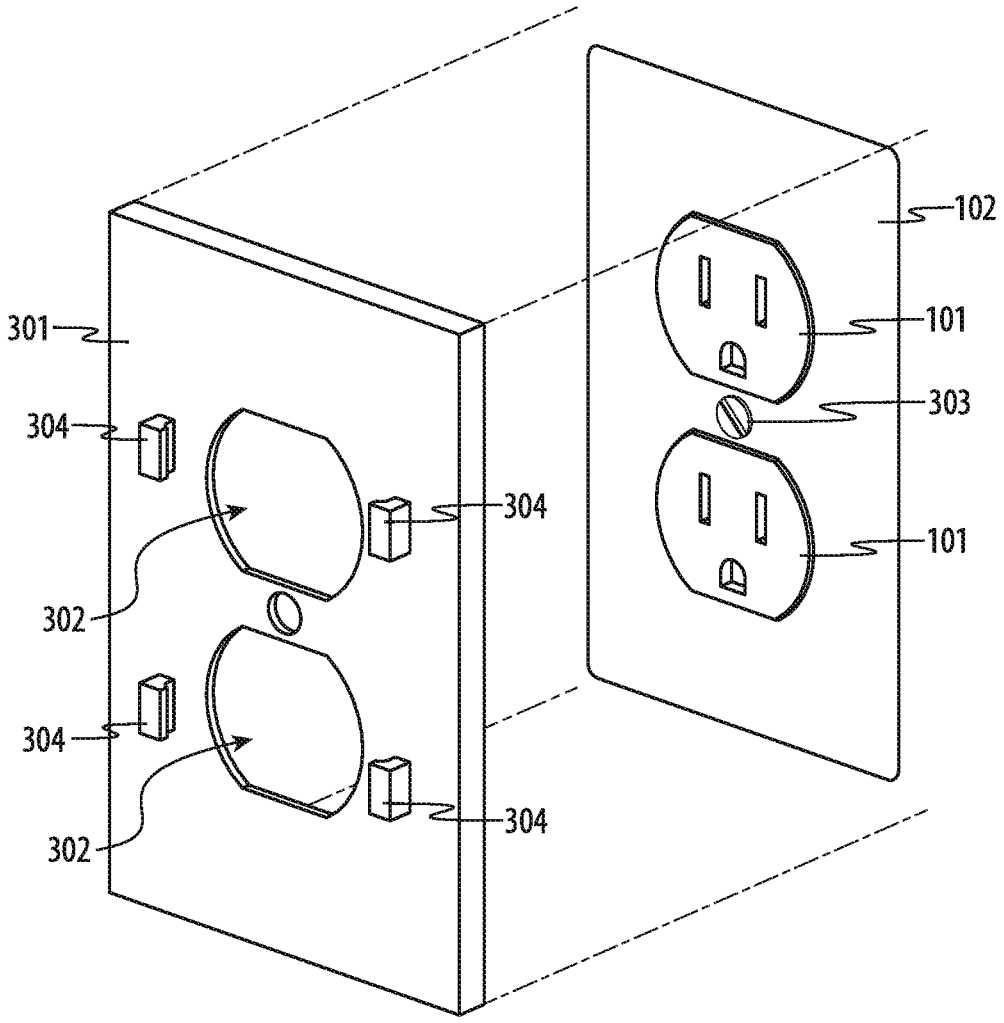
FIG. 3 shows a perspective view of an alternate embodiment of an outlet cover.

FIG. 3 illustrates an alternate embodiment of a cover plate 301 which includes an openings 302 to allow access to electrical outlets 101. Cover plate 301 may be attached to the outlet 302 by a screw 303 at the approximate center of plate 301 as shown in FIG. 1A above. However it should be expressly understood that attachment at the ends of cover plate 101 as shown in FIG. 1B above may also be utilized with departing from the scope of the disclosed embodiment. Cover plate 301 may be attached to the outlet over existing cover plate 102 or as a replacement therefor. Cover plate 301 includes anchoring points which may include one or more protruding portions 304 to which an engagement mechanism (not shown) may be removably attached. As will be discussed below, the interaction of the engagement mechanism and the protruding portion may be utilized to secure one or more encasing hoods containing electric plugs into one or both of the electrical outlets 101.

Figure 4:
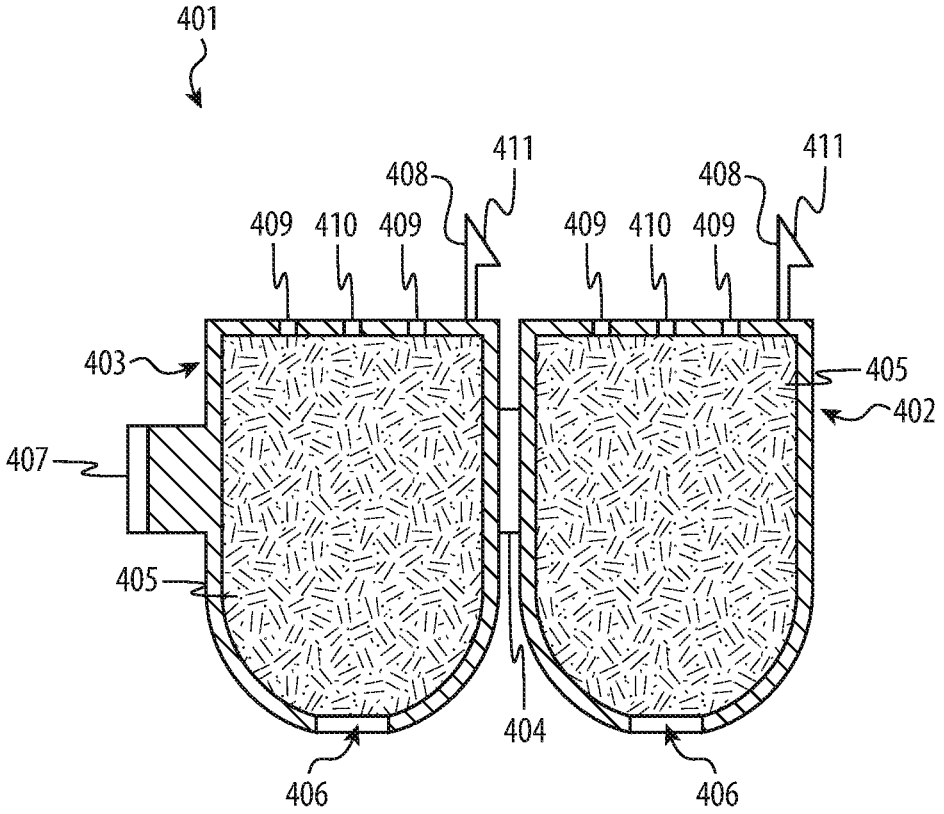
FIG. 4 shows a side view of an open encasing hood.

Referring to FIG. 4, an encasing hood 401 is shown in an open position. A first portion 402 and a second portion 403 are shown hingedly connected at 404. Hinge 404 may be a conventional hinge or may be a flexible plastic portion such that portions 402 and 403 may open to allow a plug (not shown) to be encased between portions 402 and 403 when those portions are closed. In some embodiments, hinge 404 is omitted and the two portions 402 and 403 are separate and may snap or be otherwise matably engaged. An insulating material 405 such as foam or other flexible material may optionally be contained in portions 402 and 403 to provide a cushion and secure fit for electrical plug (not shown). Portions 402 and 403 each include an opening 406 to allow a cord (not shown) from the electrical plug enclosed therein to pass through and extend outside the encasing hood 401 when portions 402 and 403 are matably engaged in a closed position.

A latching mechanism 407 on one or both portions 402 and 403 may be used to releasably secure portions 402 and 403 when they are closed to encase the electrical plug. The latching mechanism may be opened and closed and reused as needed to allow electrical plugs from various devices to be inserted or removed from between portions 402 and 403 as desired. An engagement mechanism 408 is attached to the outside of each of portions 402 and 403. These engagement mechanisms 408 include teeth 411 to releasably engage with notches in recessed portions 204 and/or protruding portions 304 in an outlet cover 201/301 as will be described below. While teeth 411 are shown, it should be expressly understood that any type of mechanical engagement mechanism may be used. Slots 409 in portions 402/403 align to allow electrical prongs of the plug (not shown) to extend from encasing hood 401 when portions 402 and 403 are closed and latched by mechanism 407. An optional opening 410 in portions 402/403 may extend a distance into portions 402/403 sufficient to permit a grounding prong of a plug to extend from hood 401 in those applications which utilize a three prong plug.

Figure 5:
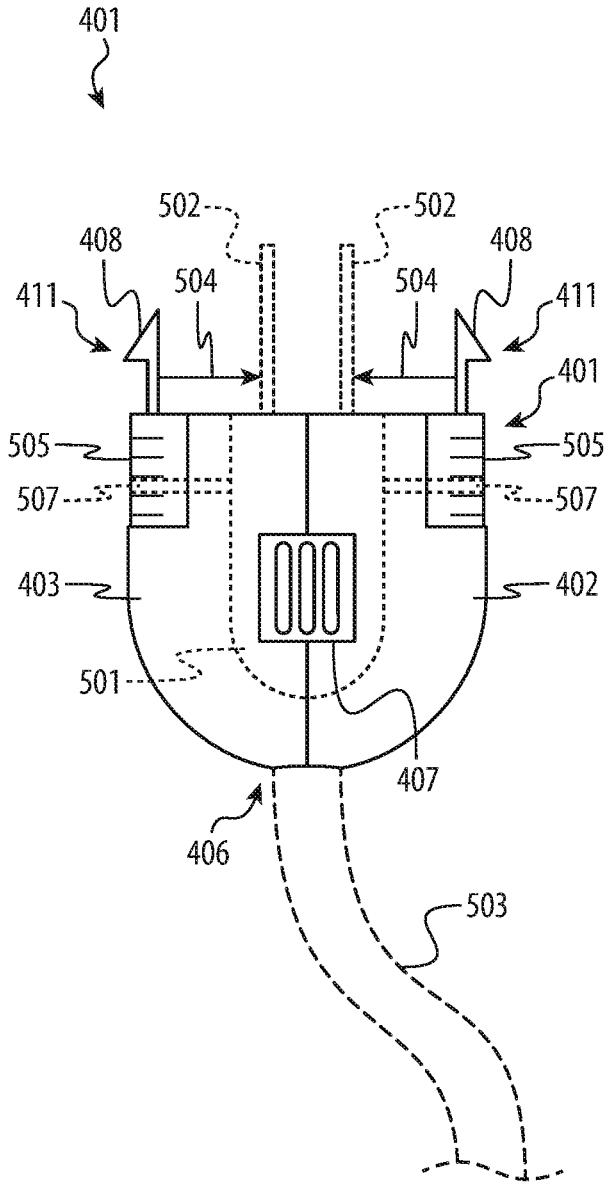
FIG. 5 shows a closed encasing hood with plug enclosed therein.

Referring to FIG. 5, encasing hood 401 is shown in a closed position with electrical plug 501 contained therein. Latching mechanism 407 maintains portions 402 and 403 in a closed position to contain plug 501. Electrical prongs 502 from plug 501 extend from encasing hood 401 such that they may be plugged into an outlet 101. As described above with respect to FIG. 4, an additional opening 410 may be included in applications using a grounding prong on plug 501. Opening 406 allows electrical cord 503 to extend from plug 501 in encasing hood 401. Engagement mechanisms 408 may be flexible or movable to releasably engage with a mating lip or groove in recesses 204. That is, encasing hood 401 may be pressed against outlet cover 201 such that engagement mechanisms 408 including notches 411 snap into recesses 204 when prongs 502 are inserted into electrical outlet 101. Release mechanisms 505 may be moved toward one another as shown by arrows 504 when a user (not shown) presses inwardly on release mechanisms 505. To disengage hood 401 from the outlet cover 201, the user pinches release mechanism 505 and engagement mechanisms 408 move such that teeth 411 disengage from recesses 204 and encasing hood 401 containing plug 501 may be pulled away from outlet cover 201 to electrically disengage electrical prongs 502 from outlet 101.

In an alternate embodiment, referring to FIG. 5, engagement mechanisms 408 may be flexible or movable to releasably engage with protruding portions 304 in FIG. 3. That is, encasing hood 401 may be pressed against outlet cover 201 such that engagement mechanisms 408 flexibly engage with protruding portions 304 when prongs 502 are inserted into electrical outlet 101. Engagement mechanisms 408 may be moved toward one another as shown by arrows 504 when a user (not shown) presses on release mechanism 505. To disengage hood 401 from the outlet cover 201, the user pinches release mechanism 505 and engagement mechanisms 408 move such that teeth 411 disengage from protruding portions 304 and encasing hood 401 containing plug 501 may be pulled away from outlet cover 201 to electrically disengage electrical prongs 502 from outlet 101.

Referring again to FIG. 5, in some embodiments, a key pin 507 may be used to further secure attachment so as to make it more difficult to unlock and thus unplug the plug 501 from the outlet 101. In this embodiment one or more key pins 507 may extend through release mechanisms 505 into encasing hood 401 so as to prevent movement of release mechanism 505 and engagement mechanisms 408 when a user pinches release mechanism 505. Key pin 507 may be a set screw that may be moved into and out of encasing hood against plug 501 to prevent movement of release mechanisms 505 in the directions 504 when key pins 507 are tightened against plug 501. A screwdriver, allen wrench or other device may be used to move key pins into and out of position to lock or unlock movement of release mechanisms.

Figure 6:
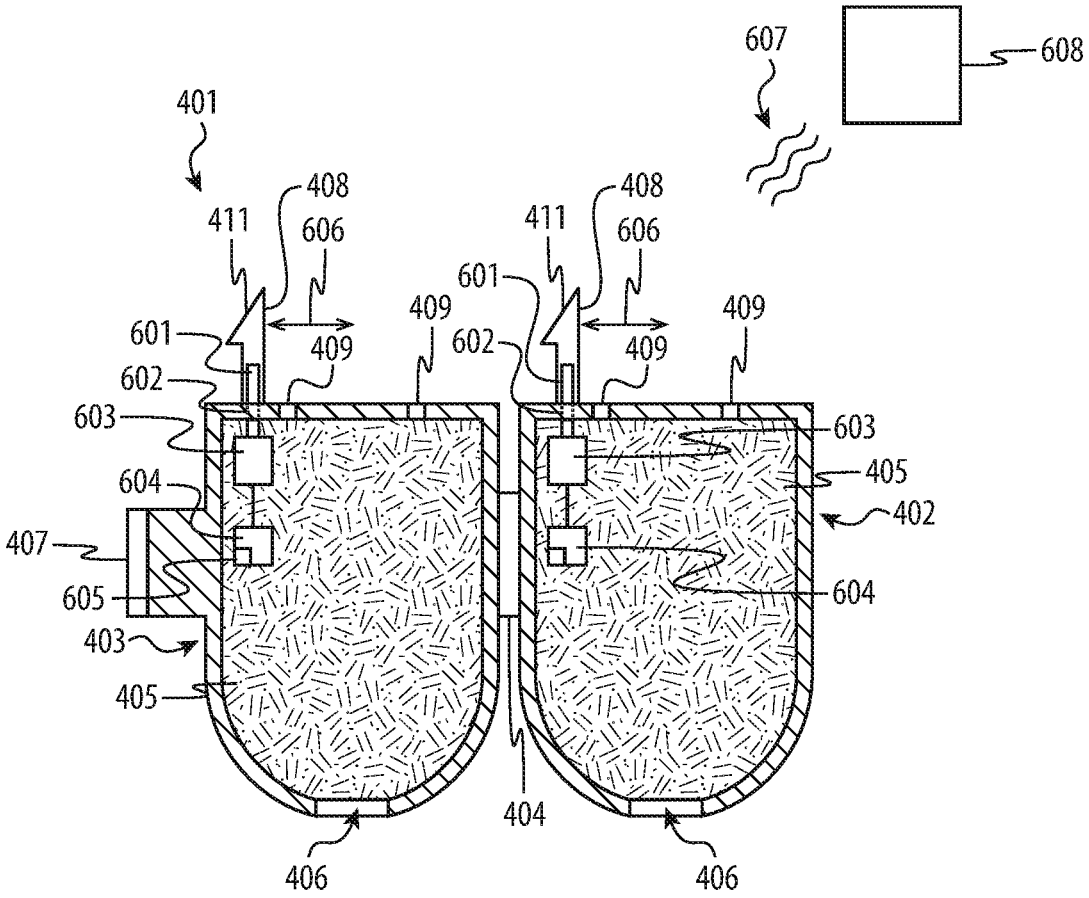
FIG. 6 shows an alternate encasing hood with movable interlocks.

Referring to FIG. 6, an encasing hood 401 similar to that shown in FIG. 4 is shown in an open position. A first portion 402 and a second portion 403 are shown hingedly connected at 404. Hinge 404 may be a conventional hinge or may be a flexible plastic portion such that portions 402 and 403 may open to allow a plug (not shown) to be placed therebetween. In some embodiments, hinge 404 is omitted and the two portions 402 and 403 are separate and may snap or otherwise be matably engaged. An insulating or flexible material 405 such as foam or other flexible material may optionally be contained in portions 402 and 403 to provide a cushion and secure fit for electrical plug (not shown). Portions 402 and 403 each include an opening 406 to allow a cord (not shown) from the electrical plug enclosed therein to pass through and extend outside the encasing hood 401 when portions 402 and 403 are closed.

As with the embodiment shown in FIG. 4, a latching mechanism 407 on one or both portions 402 and 403 may be used to releasably secure portions 402 and 403 when they are closed to contain the electrical plug. The latching mechanism may be opened and closed and reused as needed to contain electrical plugs from various devices. Slots 409 in portions 402/403 align when closed to allow electrical prongs (not shown) to expend from encasing hood 401 when portions 402 and 403 are closed and latched by mechanism 407. As described above with respect to FIG. 4, an additional opening 410 may be included in applications using a grounding prong on plug 501.

In an alternate embodiment shown in FIG. 6, engagement mechanism 408 is movably attached to the outside of each of portions 402 and 403. Engagement mechanisms 408 include teeth 411 to releasably engage with recessed portions 204 and/or protruding portions 304 in an outlet cover 201/301 as has been described herein. However, in this embodiment, the movement of engagement mechanisms 408 is accomplished remotely as described below rather than manually as with the embodiment described above in FIG. 4.

Referring again to FIG. 6, a movable arm 601 extends through a wall 602 in portions 402/403 such that the arms 601 are movable to the left and/or right in FIG. 6. Movable arms are connected to a servo motor 603 which moves arms 602 to the left and/or right as shown at 606 in FIG. 6. Each servo motor 603 is controlled by a control unit 604 which includes a conventional power supply such as a battery (not shown) and a wireless antenna and associated electronics as is known in the art to allow wireless signals 607 to and from a mobile electronic device 608 including a mobile phone, tablet or computer to be sent and received by control unit 604.

Control unit 604 in encasing hood 401 includes a controller 605 that may execute instructions and carry out operations as are described herein. Using instructions from device memory, controller 605 may regulate the reception and manipulation of input and output data between components of the control unit 604. Controller 605 may be implemented in a computer chip or chips. Various architectures can be used for controller 605 such as microprocessors, application specific integrated circuits (ASIC's) and so forth. Controller 605 together with an operating system may execute computer code and manipulate data. The operating system may be a well-known system such as iOS, Windows, Unix or a special purpose operating system or other systems as are known in the art. Controller 605 may include memory capability to store the operating system and data. Controller 605 may also include application software to implement various functions associated with the control unit 604.

A user may establish a wireless connection between control unit 604 and portable electronic device 608 through an internet service provider or other wireless carrier. By downloading an "app" the user may thus remotely control movement of movable arms 601 in portions 402/403 such that the arms 601, and the engagement mechanisms 408 attached thereto, are movable to the left and/or right as shown at 606 in FIG. 6. The user thus remotely controls engagement mechanisms 408 interconnecting with one or more recessed portions 204 and/or protruding portions 304 in outlet cover plate 201 or 301 respectively. This remote "locking" of arms 601 prevents unintended or unintentional disengagement of encasing hood 401 with outlet cover plate 201/301 and thus the unintended or unintentional disengagement of electrical plug 501 from the electrical outlet 101. In this manner the user may provide additional "childproofing" of the one or more electrical plugs/outlets by locking the arms into the recessed portions which may then only be unlocked by the portable electronic device. For example, for so long as a child is awake, a user may elect to "lock" all outlets while in other applications, for example when a child is sleeping, a user may select one or more specific outlets to be "locked".

Figure 7:
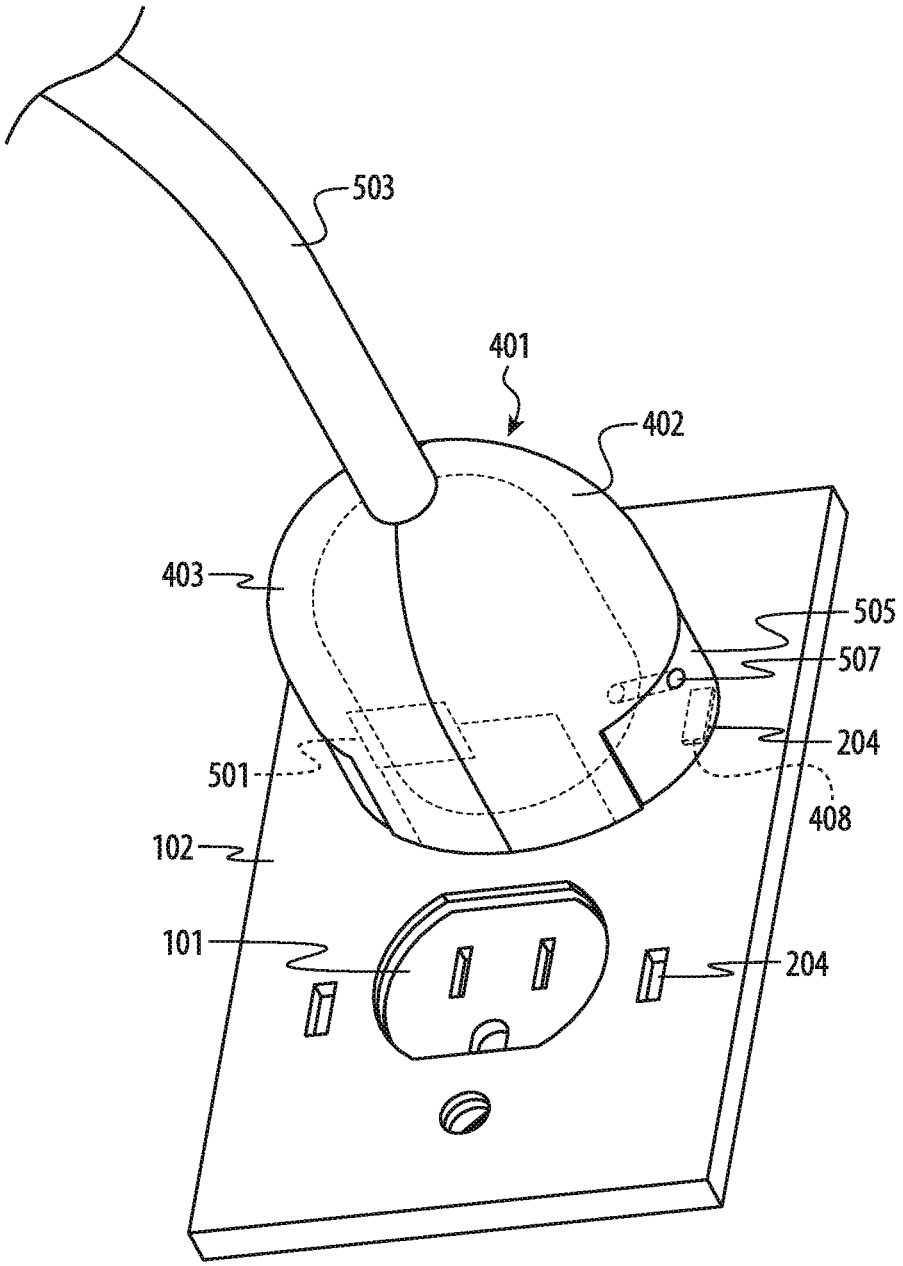
FIG. 7 shows an encasing hood engaged with the outlet cover.

Referring to FIG. 7, a perspective view of plug 501 plugged into socket 101. First and second portions 402/403 of encasing hood 401 surround plug 501. Engagement mechanism 408 is releasably engaged with recessed portions 204 as described herein. As described above with respect to FIG. 5, release mechanism 505 may be pressed to disengage hood 401 from the outlet cover 201. That is, the user pinches release mechanism 505 and engagement mechanisms 408 move such that teeth 506 disengage from recessed portions 204 or protruding portions 304 and encasing hood 401 containing plug 501 may be pulled away from outlet cover 201 to electrically disengage electrical prongs 502 from outlet 101. Referring to FIGS. 6 and 7, a user may remotely engage or disengage teeth 411 in engagement mechanism 408 to allow plug 501 to be pulled away from outlet cover 201 to electrically disengage electrical prongs 502 from outlet 101.

Referring to FIGS. 5 and 7, a user may insert key pins 507 on one or both sides of hood 401 to further secure attachment so as to make it more difficult to unlock and thus unplug the cord from the outlet. As described with respect to FIG. 5, one or more key pins 507 may extend into encasing hood 401 so as to prevent movement of release mechanism 505 and engagement mechanisms 408 when a user pinches release mechanism 505. In one embodiment, key pin 507 may be a screw that may be moved into and out of encasing hood to prevent movement of release mechanisms 505 in the directions 504 when key pins 505 are inserted. A screwdriver, allen wrench or other device (not shown) may be used to move key pins 507 into and out of position to block or unblock movement of release mechanisms 505.

Figure 8:
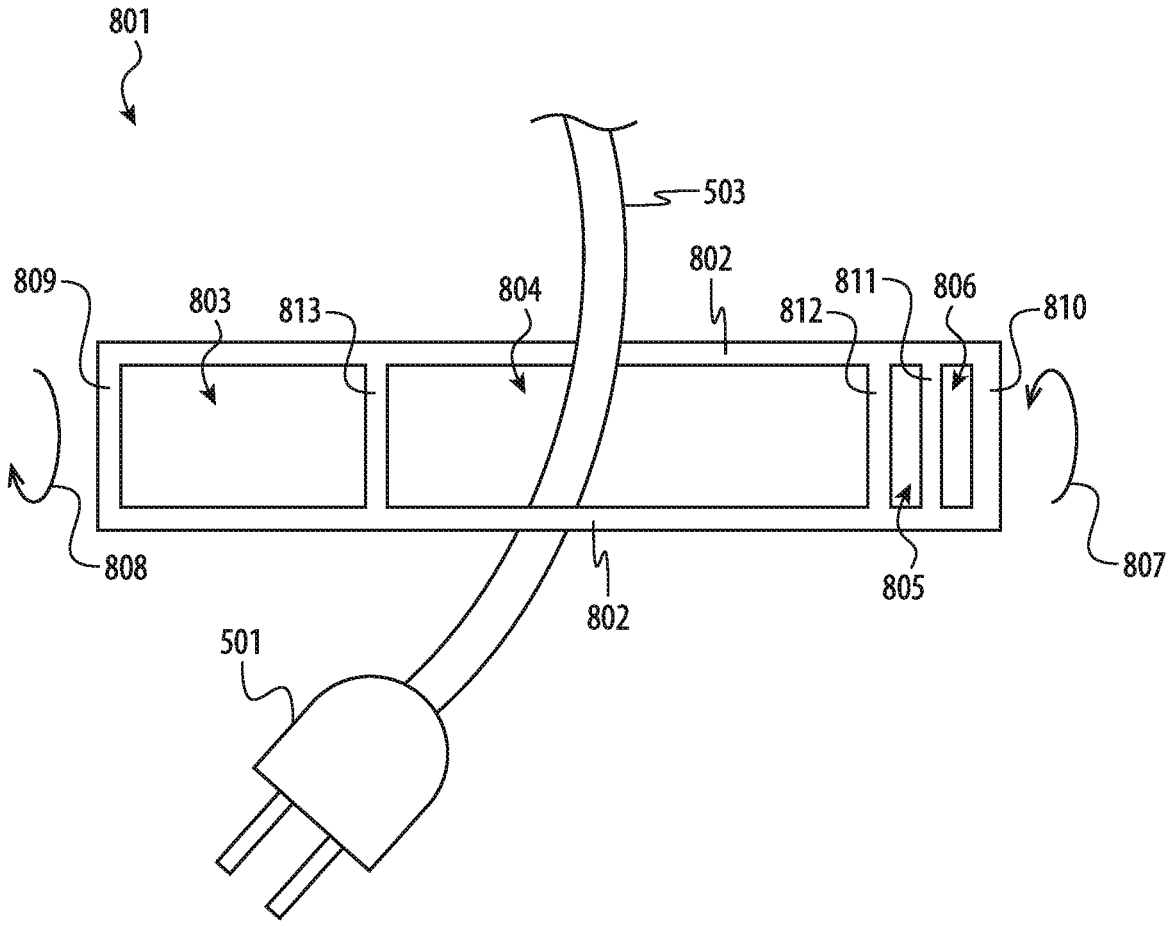
FIG. 8 shows an alternate embodiment employing an elastomeric band.
Figure 9:
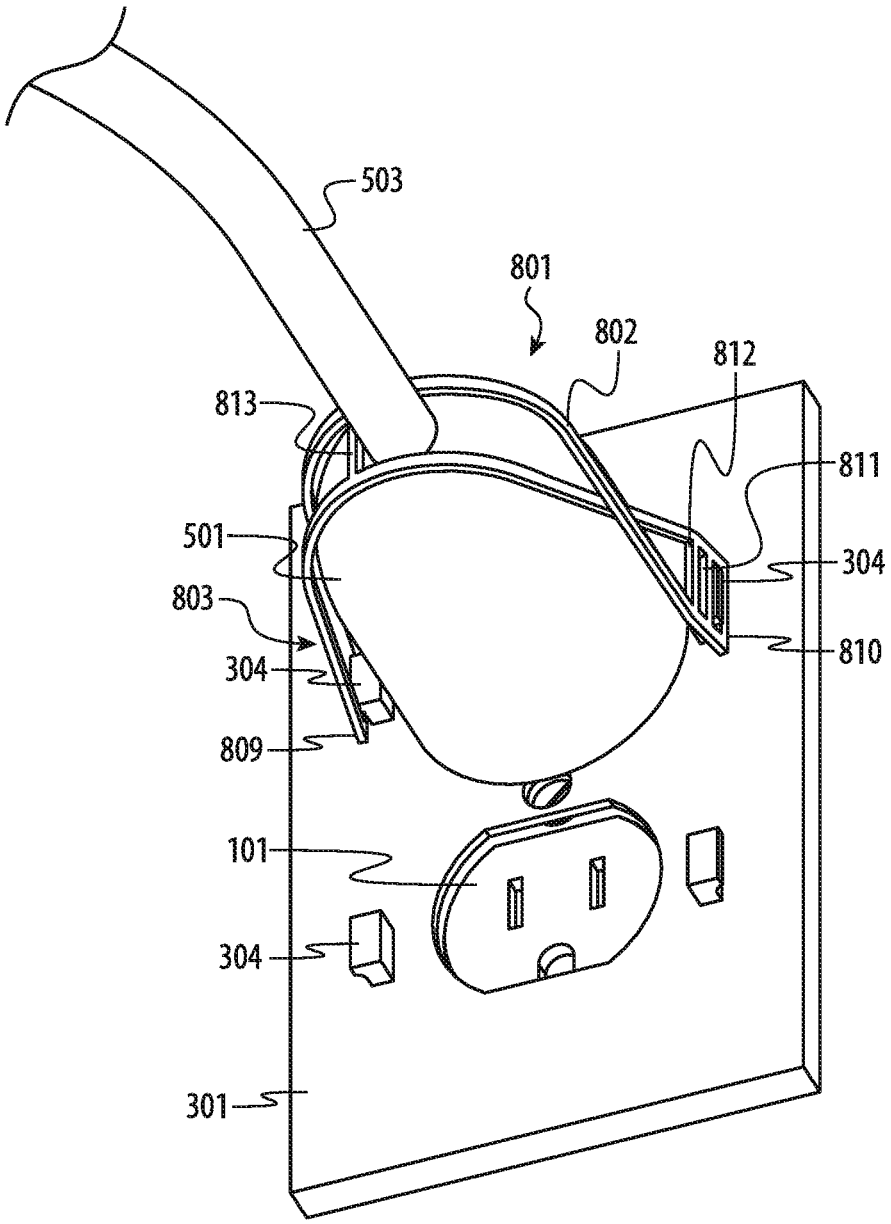
FIG. 9 shows an elastomeric band engaged with the outlet cover.

Referring to FIGS. 8 and 9, in an alternate embodiment a flexible elastomeric device 801 may be used to secure plug 501. Device 801 includes an elastomeric material which may be rubber or other material that stretches or is otherwise flexible. Device 801 includes first open portion 803, second open portion 804, third open portion 805, and fourth open portion 806 defined by side portions 802 and cross portions 809 and 810-813. While four open portions are used in this embodiment, it should be understood that any number of two or more open portions may be employed. The plug 501 and cord 503 may be passed through second open portion 804 and the elastomeric device 801 may than be twisted in one or both directions as shown by arrows 807/808 thereby securing cord 503 in second open portion 804 against a cross portion 813 and side portions 802 that have been twisted to overlap as shown in FIG. 9.

Referring again to FIGS. 8 and 9, once plug 501 and cord 503 have been secured to elastomeric device, plug 501 can be plugged into outlet 101. First open portion 803 is passed over a protruding portion 304 such that cross portion 809 engages with protruding portion 304. Device 801 is then stretched around plug 501 such that at least one of cross portions 810, 811, or 812 is engaged with a protruding portion 304 on the opposite side of cover 301 as shown in FIG. 9. That is, the protruding portion 304 may pass through opening 804, 805 or 806 depending upon the desired tension to be exerted on plug 501 by elastomeric side portions 802. The force is determined by the user to be sufficient to secure plug 501 into plug 101. While three open portions 804-806 are used on one side in this embodiment, it should be understood that any number of one or more open portions may be employed.

Figure 10:
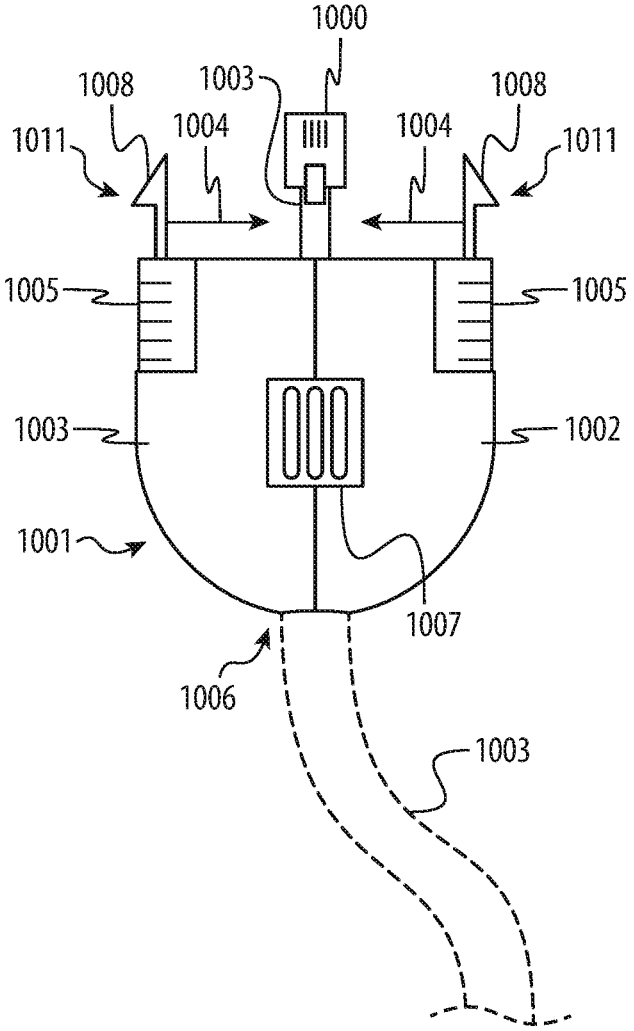
FIG. 10 shows an RG 11 or other data connector in an encasing hood.

In an alternate embodiment, referring to FIG. 10, a data connector 1000 is shown in encasing hood 1001 lieu of plug 501 shown in encasing hood 401 as described above with respect to FIGS. 4-7. A perspective view of a data connector 1000 shown extending from an encasing hood 1001 with encasing hood 1001 shown in a closed position and at least a portion of data connector 1000 and/or data cable 1003 contained therein. Latching mechanism 1007 maintains portions 1002 and 1003 in a closed position to contain data connector 1000. Data connector 1000 extends from encasing hood 1001 such that it may be plugged into a data outlet (not shown). Opening 1006 allows data cable 1003 to extend from encasing hood 1001. Engagement mechanisms 1008 including teeth 1011 may be flexible or movable to allow teeth 1011 to releasably engage with a mating lip or groove in recesses 204 as described herein. That is, encasing hood 1001 may be pressed against outlet cover 201 such that engagement mechanisms 1008 snap into recesses 204 when data connector 1000 is inserted into data outlet (not shown). Engagement mechanisms 1005 may be moved toward one another as shown by arrows 1004 when a user (not shown) presses inwardly on release mechanisms 1005. To disengage hood 1001 from the outlet cover 201, the user pinches release mechanism 1005 and engagement mechanisms 1008 move such that teeth 1011 disengage from recesses 204 and encasing hood 1001 containing data connector 1000 may be disengaged from and pulled away from data outlet (not shown).

Figure 11:
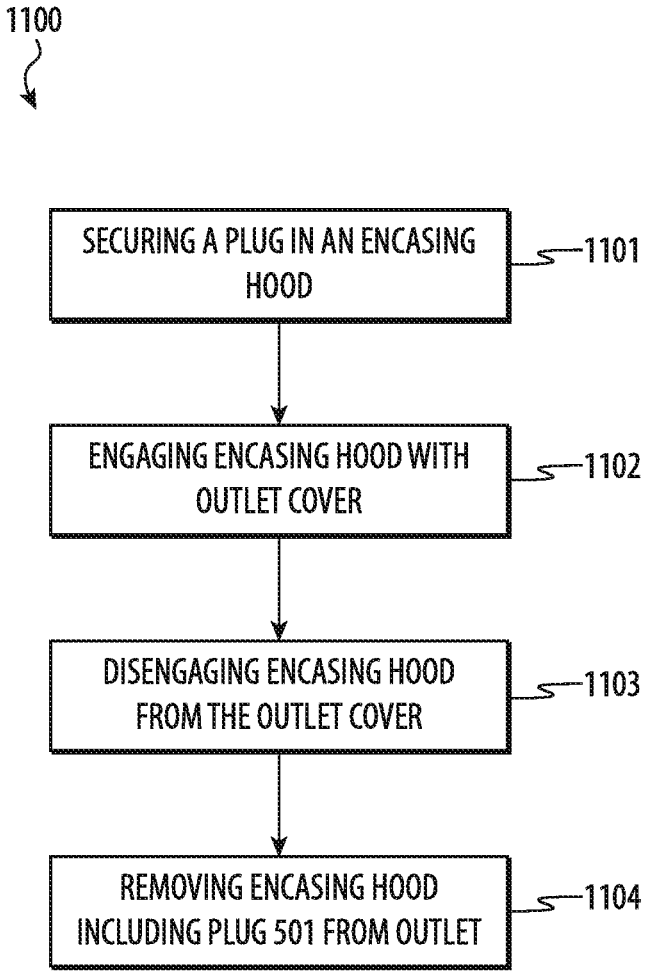
FIG. 11 is a flow chart showing a method for securing and removing a plug.

FIG. 11 is a flow chart 1100 showing a method for securing a plug to an outlet cover. In operation 1101 a plug 501 is encased in an encasing hood 401*by* closing a first portion 402 and a second portion 403 around plug 501 such that electrical connecting prongs 502 may extend from hood 401 and be plugged into an electrical outlet. As part of operation 1101 the user secures latching mechanism 407 on one or both portions 402 and 403 to releasably secure portions 402 and 403 to encase the electrical plug. In an alternate embodiment, portions 402 and 403 may snap together to encase plug 501. The latching mechanism may be opened and closed and reused as needed to allow electrical plugs from various devices to be inserted or removed from between portions 402 and 403 as desired.

Referring again to FIG. 11, in operation 1102 a user engages engagement mechanism 408 to releasably engage with recessed portions 204 and/or protruding portions 304 in an outlet cover 201/301 as described herein. In operation 1102 the engagement mechanism may include flexible portions so that pressure from a user may allow engagement or the user may manually engage mechanism 408 including teeth 411 with recessed portions 204 and/or protruding portions 304 in an outlet cover 201/301. Engagement mechanisms 408 may be flexible or movable in encapsulating hood 401 to releasably engage with a mating lip or groove in recesses 204 such that engagement mechanisms 408 flexibly engage with protruding portions 304 when prongs 502 are inserted into electrical outlet 101. That is, encasing hood 401 may be pressed against outlet cover 201 such that teeth 411 in engagement mechanisms 408 snap into recesses 204 when prongs 502 are inserted into electrical outlet 101.

In operation 1103, engagement mechanisms 505 may be moved toward one another as shown by arrows 504 when a user (not shown) presses inwardly on release mechanisms 505 to engage or disengage hood 401 from the outlet cover 201. In operation 1103, the user pinches release mechanism 505 and engagement mechanisms 408 move such that teeth 411 disengage from recesses 204. In operation 1104, upon disengagement, encasing hood 401 containing plug 501 may be pulled away from outlet cover 201 to electrically disengage electrical prongs 502 from outlet 101.

Referring again to FIG. 11, in some embodiments, as part of operations 1102 and 1103 to engage or disengage hood 401 from outlet cover 101 a key pin 507 may be used to further secure attachment so as to make it more difficult to unlock and thus unplug the cord from the outlet. In this embodiment one or more key pins 507 may extend into encasing hood 401 through release mechanism so as to prevent movement of release mechanism 505 and engagement mechanisms 408 when a user pinches release mechanism 505. Key pin 507 may be a screw that may be moved into and out of encasing hood to contact plug 501 preventing movement of release mechanisms 505 in the directions 504 when key pins 507 are in position against plug 501. A screwdriver, allen wrench or other device may be used to move key pins into and out of position to block or unblock movement of release mechanisms 505.

In an alternate embodiment shown in FIG. 6, operations 1102 and 1103 include the movement of engagement mechanisms 408 remotely as described with respect to FIG. 6. Referring again to FIG. 6, a movable arm 601 extends through a wall 602 in portions 402/403 such that the arms 601 are movable to the left and/or right in FIG. 6. Movable arms are connected to a servo motor 603 which moves arms 602 to the left and/or right as shown at 606 in FIG. 6. Each servo motor 603 is controlled by a control unit 604 which includes a conventional power supply such as a battery (not shown) and a wireless antenna and associated electronics as is known in the art to allow wireless signals 607 to and from a mobile electronic device 608 including a mobile phone, tablet or computer to be sent and received by control unit 604.

Figure 12:
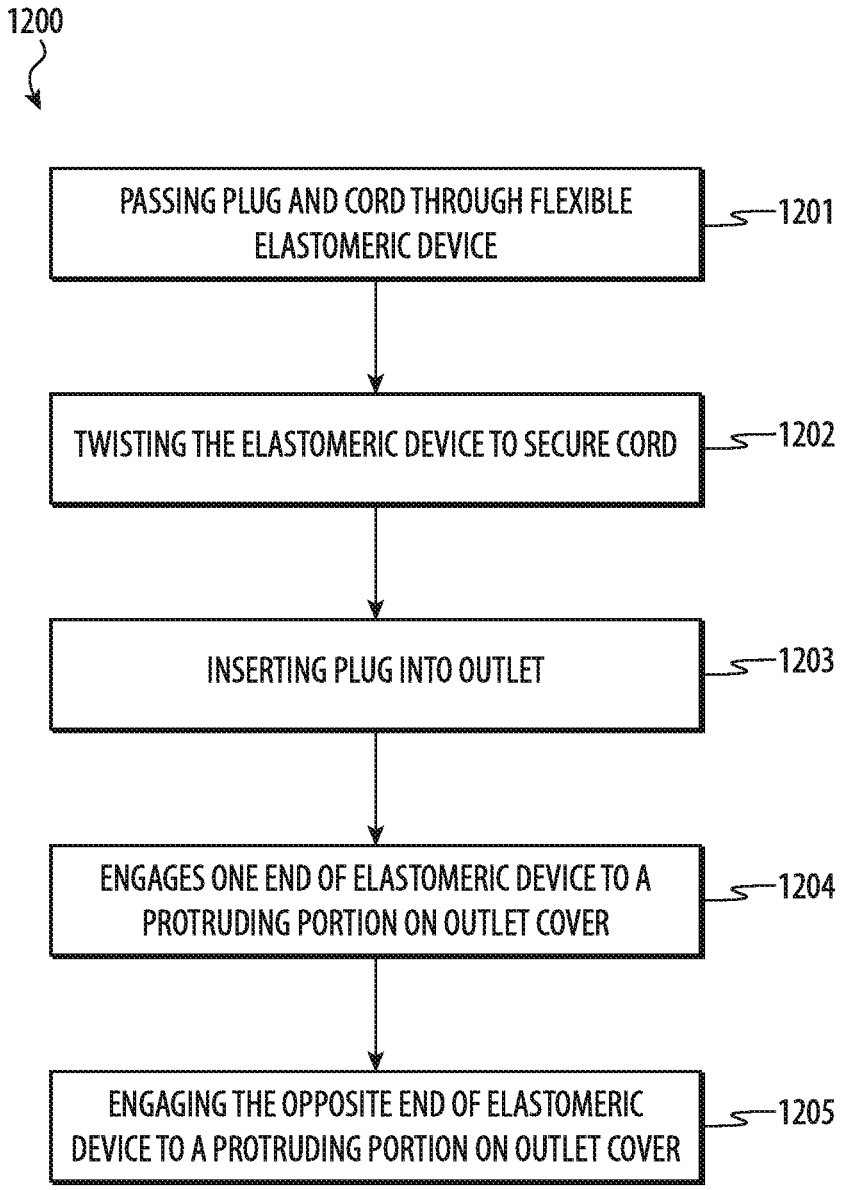
FIG. 12 is a flow chart showing an alternate method for securing and removing a plug.

FIG. 12 is a flow chart 1200 showing an alternate method for securing a plug to an outlet. In operation 1201, plug 501 and cord 503 may be passed through an open portion in flexible elastomeric device 801. In operation 1202, the elastomeric device 801 may than be twisted in one or both opposite directions as shown by arrows 807/808 in FIG. 8 to overlap as shown in FIG. 9 thereby securing cord 503 in the open portion.

Referring again to FIG. 12, once plug 501 and cord 503 have been secured to elastomeric device, in operation 1203 plug 501 can be plugged into outlet 101. In operation 1204, another open portion in elastomeric device 801 is passed over a protruding portion 304 such that protruding portion 304 engages with a cross portion in elastomeric device 801 to secure one end of elastomeric device. It should be noted that operation 1203 could be juxtaposed with operation 1204 such that plug 501 is plugged into outlet 101 after one end of device 801 is secured to protruding portion 304.

Subsequent to securing one end of device 801 in operation 1204, the opposite end of device 801 is then secured to a protruding portion 304 in operation 1205. In operation 1205 at least one of cross portions on the opposite end of device 801 is engaged with a protruding portion 304 on the opposite side of cover 301 as shown in FIG. 9. That is, the protruding portion 304 may be passed through an opening selected depending upon the desired tension to be exerted on plug 501 by the elastomeric device. A multiplicity of open portions and cross portions may be included to allow a user to select the desired tension on device 801. The tension force is determined by the user to be sufficient to secure plug 501 into plug 101.

The foregoing description, for purposes of explanation, used specific nomenclature to provide a thorough understanding of the described embodiments. However, it will be apparent to one skilled in the art that the specific details are not required in order to practice the described embodiments. Thus, the foregoing descriptions of the specific embodiments described herein are presented for purposes of illustration and description. They are not targeted to be exhaustive or to limit the embodiments to the precise forms disclosed. It will be apparent to one of ordinary skill in the art that many modifications and variations are possible in view of the above teachings.

What is claimed is:

1. A device for securing a plug in an outlet comprising:
an encasing hood for releasably containing the plug;
an outlet cover adjacent the outlet;
the outlet cover including at least one anchoring point;
an engaging mechanism on the encasing hood for releasably engaging with the at least one anchoring point, the engaging mechanism including:
at least one movable arm extending through the encasing hood into the engagement mechanism;
a servo motor connected to the at least one movable arm;
a control unit connected to the servo motor, the control unit configured to cause the servo motor to move the at least one movable arm in a first direction in response to receiving a remote signal, the at least one movable arm causing the engagement mechanism to move in the first direction to lock with the at least one anchoring point; and
a release mechanism on the encasing hood for disengaging the engaging mechanism from the anchoring point, the release mechanism causing the at least one movable arm within the engagement mechanism to move in a second direction to release the engagement mechanism from the at least one anchoring point.

2. The device of claim 1 wherein the at least one anchoring point includes two recesses in the outlet cover.

3. The device of claim 1 wherein the at least one anchoring point includes two protruding portions on the outlet cover.

4. The device of claim 1 wherein the encasing hood includes:
a first portion;
a second portion matable with the first portion, the first and second portions hingedly attached; and
a latching mechanism on the first portion and on the second portion to secure the first portion and the second portion around the plug.

5. The device of claim 1 wherein the encasing hood includes:
a first portion;
a second portion matable with the first portion; and
a snapping mechanism on the first portion and on the second portion to releasably secure the first portion and the second portion around the plug.

6. The device of claim 1 wherein the anchoring points include at least one recessed portion or protruding portion in the outlet cover.

7. The device of claim 6 wherein the engaging mechanism includes teeth to releasably engage with notches in the at least one recessed portion or protruding portion.

8. The device of claim 1 wherein the release mechanism includes at least one key pin to secure the release mechanism.

9. A method for securing a plug to an outlet comprising the operations of:
encasing the plug in an encasing hood;

causing an engagement mechanism to engage with anchor points on an outlet cover;

locking the engagement mechanism to the anchor points in response to a first remote signal comprising causing a control unit to instruct a servo motor to move a movable arm within the engagement mechanism in a first direction in response to the first remote signal, wherein the movable arm causes the engagement mechanism to move in the first direction to lock the engagement mechanism with the anchor points;

unlocking the engagement mechanism from the anchor points in response to a second remote signal comprising causing the control unit to instruct the servo motor to move the movable arm within the engagement mechanism in a second direction in response to the second remote signal, wherein the movable arm causes the engagement mechanism to move in the second direction to unlock the engagement mechanism from the anchor points;

causing the engagement mechanism to disengage from the anchor points on the outlet cover; and pulling the encasing hood containing the plug from the outlet cover to electrically disengage the plug from the outlet.

10. The method of claim 9 wherein the first remote signal and the second remote signal are received from a portable electronic device.

11. The method of claim 9 wherein the operation of encasing further comprises securing a latching mechanism on the encasing hood to encase the electrical plug.

12. The method of claim 9 wherein the operation of encasing further comprises snapping a first portion to a second portion of the encasing hood to encase the electrical plug.

13. The method of claim 9 wherein the operation of causing the engagement mechanism to engage with anchor points on an outlet cover further comprises pressing the encasing hood against the outlet cover such that flexible teeth in the engagement mechanisms snap into recesses in an outlet cover when the plug is inserted into electrical outlet.

14. The method of claim 13 wherein the operation of causing the engagement mechanism to disengage from the anchor points on the outlet cover further comprises causing the flexible teeth in the engagement mechanism to disengage from the anchor points on the outlet cover.

15. The method of claim 9 wherein the operations of engaging and disengaging include inserting or removing a key pin in the encasing hood.

* * * * *